United States Patent [19]

Meserole

[11] 3,996,783

[45] Dec. 14, 1976

[54] METHOD AND APPARATUS FOR REFORMING ROUND DUCTS INTO RECTANGULAR DUCTS

[75] Inventor: Robert Henry Meserole, Toledo, Ohio

[73] Assignee: Johns-Manville Corporation, Denver, Colo.

[22] Filed: Jan. 23, 1975

[21] Appl. No.: 543,701

[52] U.S. Cl. ..... 72/370; 72/392

[51] Int. Cl.[2] ..... B21B 17/02

[58] Field of Search ..... 72/392, 393, 370

[56] References Cited

UNITED STATES PATENTS

| | | | |
|---|---|---|---|
| 2,474,887 | 7/1949 | Carswell et al. | 72/392 |
| 2,916,076 | 12/1959 | Young | 72/392 |
| 3,710,609 | 1/1973 | Jones | 72/392 |

*Primary Examiner*—James R. Duzan

*Attorney, Agent, or Firm*—Robert M. Krone; Joseph J. Kelly; John H. Miller

[57] ABSTRACT

Disclosed herein is rectangular thin walled metal duct easily bendable without significantly changing the cross-sectional area at the bend. Also disclosed are methods and apparatus for forming this rectangular duct and flat/oval duct from round duct having grooves spiraling therearound.

3 Claims, 10 Drawing Figures

METHOD AND APPARATUS FOR REFORMING ROUND DUCTS INTO RECTANGULAR DUCTS

This invention relates to rectangular thin walled metal duct, and to the process and apparatus used in their manufacture.

BACKGROUND OF THE INVENTION

Round, thin walled, spirally grooved metal ducts and their method of manufacture are known as evidenced by U.S. Pat. Nos. 3,435,852 and 3,621,884. Round ducts of this type have many uses, e.g., as cold or warm air duct for residential, commercial and inductrial construction. However, these round ducts, and the method and apparatus used in their manufacture, have certain disadvantages. Round duct require an excessive wall space thickness to carry the required volume of air for many applications. In a typical interior residential wall the space between studs will easily accept a 2½ × 12 inches rectangular duct which provides a cross-sectional area of 30 square inches. A2½ inches diameter round duct, about the largest round that will fit in this space, has a cross-sectional area of only about 2 square inches.

This emphasizes the need for rectangular duct. The problem is that the method and apparatus used to make the round, thin walled spirally grooved metal duct, as is apparent from the above mentioned patents, will not produce rectangular or flat oval duct. Further, it is not apparent how this apparatus and method could be modified to make rectangular duct.

This situation has forced the use of conventional straight walled galvanized metal duct in those applications where wall thickness dimension and duct cross-sectional area are critical. This type of conventional duct, usually rectangular, does not have many of the features that the round, thin walled, spirally grooved metal duct has, e.g., the ability to be bent around curves, etc. without significantly changing the cross-sectional area at the bend, light weight and low cost due to the use of aluminum and steel sheet having a thickness of less than 10 mils and usually in the range of 3–6 mils, a continuous spiral crimped seal, and the ability to be made in a continuous manner from relatively narrow strips of metal and requiring little hand labor. Thus, the need for rectangular thin walled, spirally grooved metal is clear.

Attempts have been made to reshape round, thin walled, spirally grooved metal duct into rectangular duct by external forces, but, because of the very thin wall, the duct tends to crimp rather than be reformed into the desired shape.

The object of the present invention is a rectangular duct having the desired features of the round, thin walled, spirally grooved metal ducts, a suitable method for making such a product, and a practical apparatus for use in the method.

BRIEF SUMMARY OF THE INVENTION

The present invention comprises rectangular, thin walled spirally made metal ducts that are light weight and bendable without significantly changing the cross-sectional area of the duct at the bend.

The present invention also comprises a method of making the above described ducts comprising reshaping a round, thin walled, spirally grooved metal duct into the desired rectangular ducts by the application of a plurality of reforming forces simultaneously to the interior of the round duct.

The present invention further comprises an apparatus for practicing the above described method comprising two or more forming surfaces or members for insertion into the interior of a hollow duct, means for supporting said forming surfaces and a surrounding hollow duct, and means for moving said two or more forming surfaces apart in a direction perpendicular to the axis of the duct, while preventing any significant horizontal movement of the forming surfaces with respect to one another.

DETAILED DESCRIPTION AND PREFERRED EMBODIMENT

Figure 1:
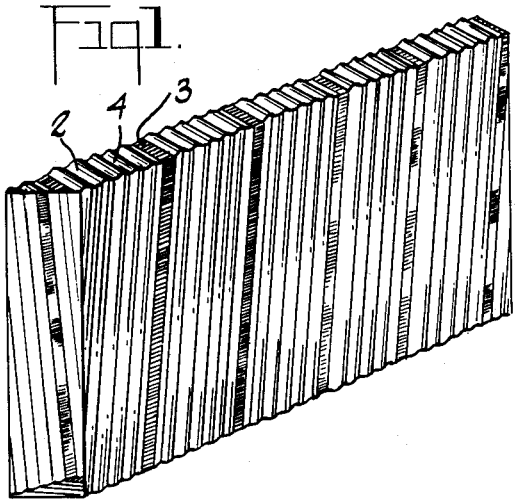
FIG. 1 is a perspective view of a section of rectangular duct of the present invention.
Figure 1A:
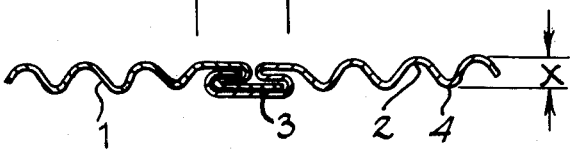
FIG. 1*a* is a partial section through a wall, and showing a seam, in the duct shown in FIG. 1.

The preferred embodiment of the rectangular duct of the present invention is shown in FIGS. 1 and 1*a*. The round duct from which this rectangular duct is made using the method and apparatus of this invention can be made by known methods, e.g., the method disclosed in U.S. Pat. No. 3,621,884. The rectangular duct shown in FIGS. 1 and 1*a* has a thin metal wall 1, usually below 10 mils in thickness and preferably in the range of 3–6 mils thick. Thicknesses greater than 10 mils can be used, but usually are not required and thus merely add to the weight and cost of the product. Depending upon the type of metal used in the round duct, it is possible to reduce the metal thickness to below 3 mils, at least for small cross-sectional area duct. Typical metals used are vinyl coated, galvanized or stainless steels and aluminum, but round ducts of any metal capable of being reshaped could be used.

The thin metal walls of the rectangular duct comprise a plurality of spiral grooves having valleys 2 and peaks 4. The distance between each successive groove and the overall wall thickness X determines the flexibility and strength of the duct. The manner of adjusting these factors to produce the desired properties is well known as disclosed in U.S. Pat. Nos. 3,435,852 and 3,621,884 the disclosures of which are herein incorporated by reference.

A continuous crimped seam 3 extends spirally along the wall of the duct. While the crimp pattern shown in FIG. 1*a* is preferred, round ducts having other known crimp patterns can be used.

Figure 2:
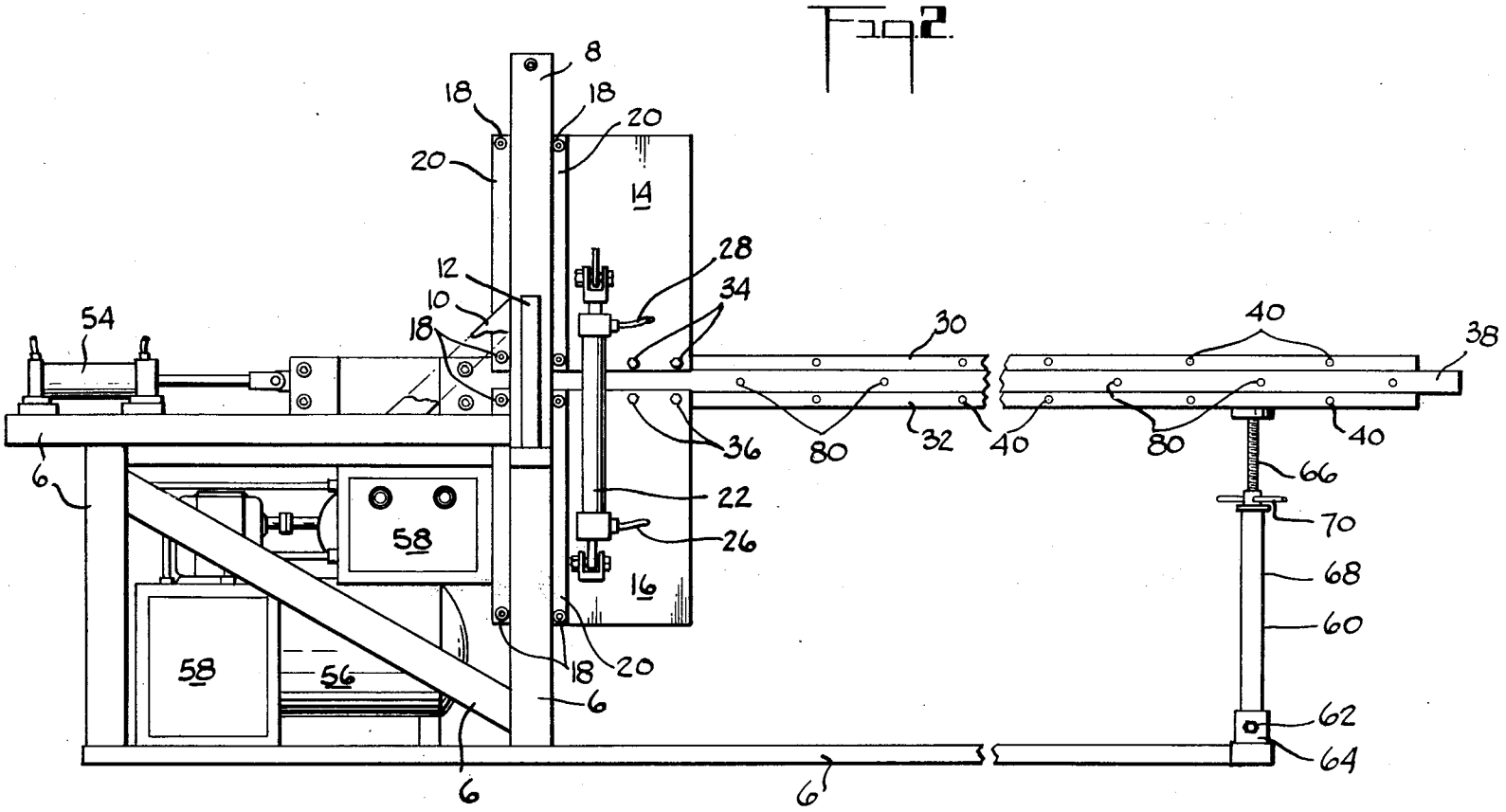
FIG. 2 is an elevational side view of a preferred embodiment of the apparatus of the present invention showing the forming members in a retracted position, and broken along its length for illustrative purposes.

The preferred apparatus for reforming round duct into rectangular or flat/oval duct is shown in FIGS. 2–9. Referring to FIG. 2, which is an elevational side view, the apparatus comprises a frame 6, which can be mounted on casters for easy movement from one area to another. Rigidly attached to the frame 6 are two spaced apart vertical box channel guides 8 braced by supports 10, partly broken away, and 12. Upper and lower die supports, 14 and 16, are held in place between the vertical guides 8 by rollers 18. These rollers allow the upper and lower die supports 14 and 16 to move up and down vertically along vertical guides 8. Hardened steel wear plates (not shown) may be fastened to the front and back faces of the vertical guides 8 for the rollers to run on if desired. Such a modification presents a smooth even surface to the rollers 18 and prevents the rollers from indenting the softer metal of the vertical guides 8 during use of the apparatus. Hardened steel strips 20 provide a better foundation for the rollers 18, and also provide a more even guide between the members 14 and 16 and the vertical guides 8.

Although the vertical guides 8 are shown as essentially square or boxed channel members (see FIG. 4), the apparatus could be modified to use round columns, open channel members, etc. by modifications within the ordinary skill of the art.

Attached to each side of the upper and lower die supports 14 and 16 are air or hydraulic cylinders 22 and 24. Extension of the rod of each of these cylinders causes members 14 and 16 to move away from one another along vertical guides 8. These cylinders are activated in either direction by pumping fluid to either one of lines 26 or 28 and exhausting fluid through the other of the two lines in a known manner.

Figure 5:
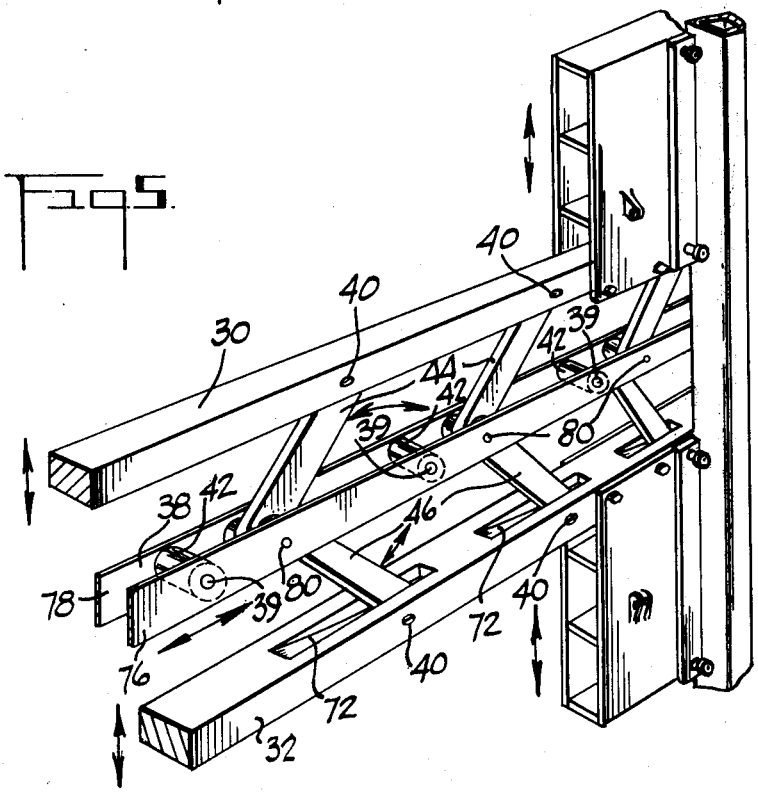
FIG. 5 is a perspective view of a portion of the apparatus shown in FIGS. 2–4 showing the linkage assembly joining the forming members which are in a partially extended position.
Figure 3:
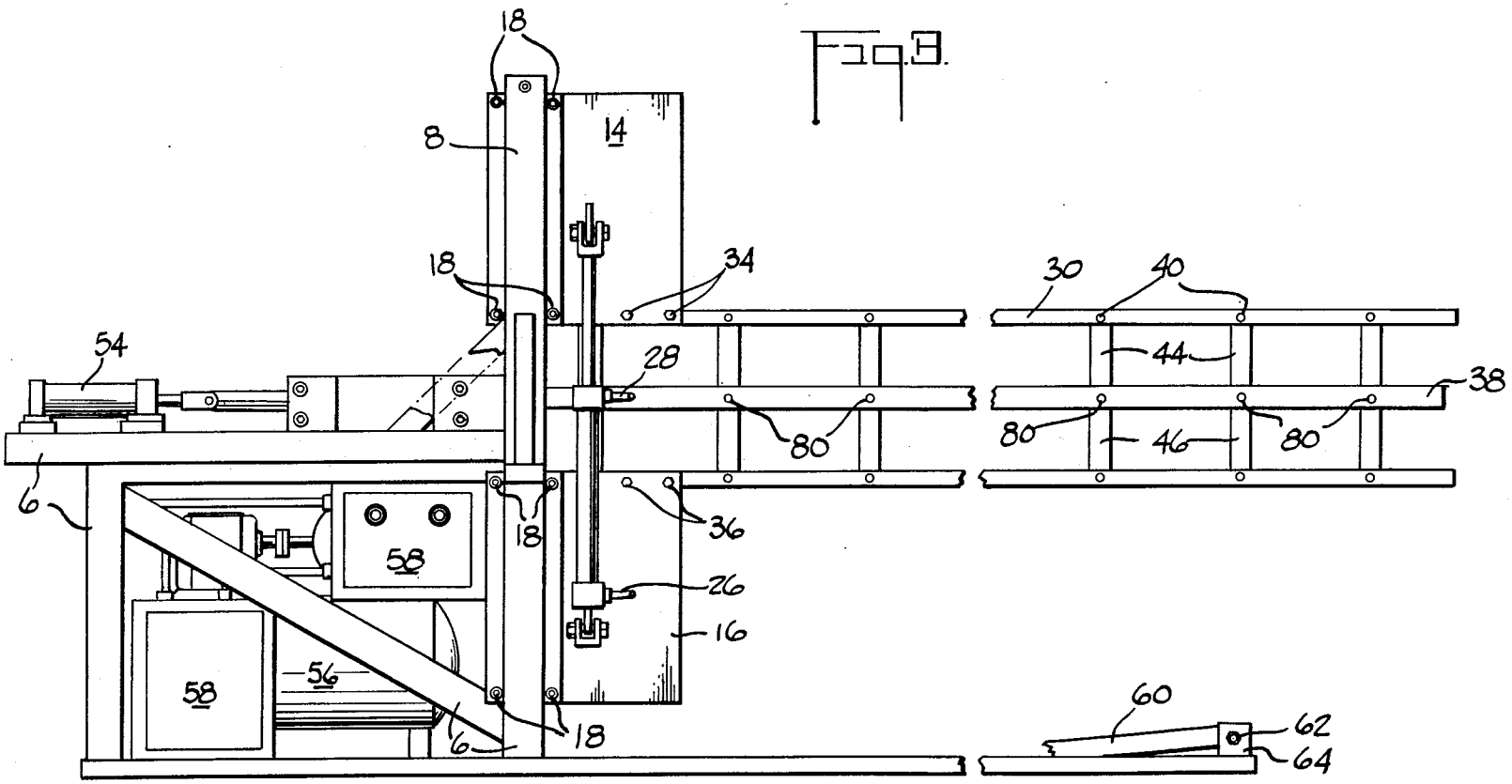
FIG. 3 is similar to FIG. 2, but shows the forming members in a fully extended position.
Figure 4:
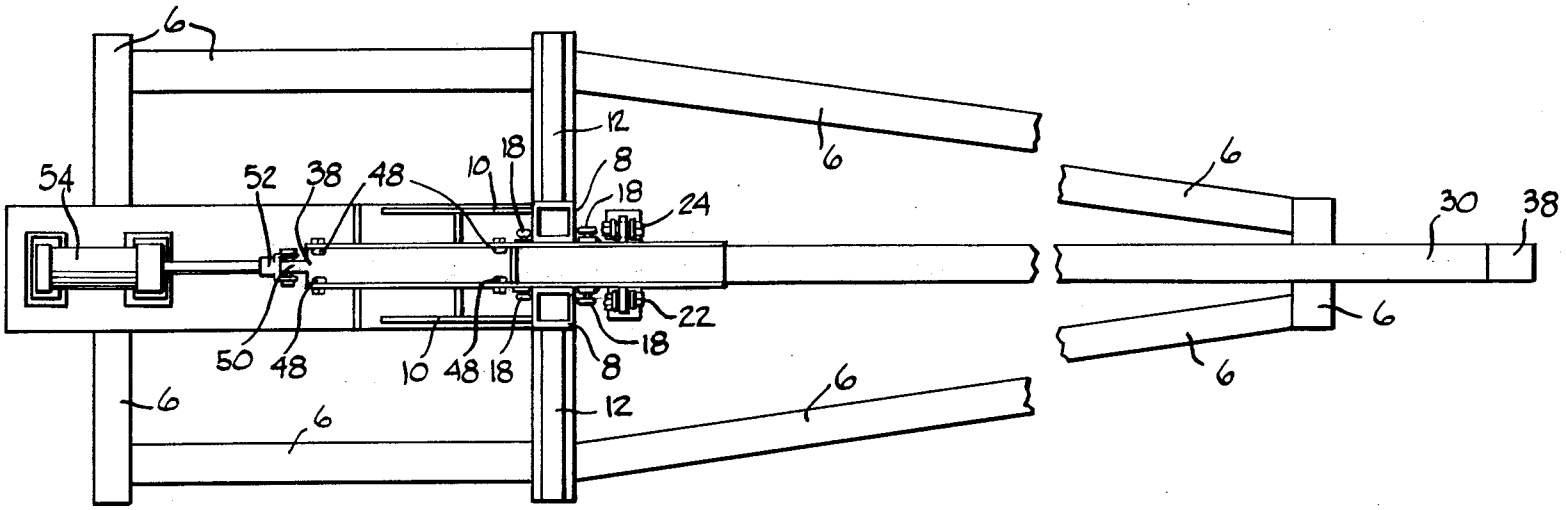
FIG. 4 is a plan view of the apparatus shown in FIGS. 2 and 3.

An upper die or forming member or reshaping surface 30 is attached to the upper die support member 14 by bolts 34 and a lower die or forming member or reshaping surface 32 is attached to the lower die supporting member 16 by bolts 36. The upper die 30 and the lower die 32 are also attached to a control rod 38 by means of pins 40 and 42, upper pivoting linkage arms 44, and lower pivoting linkage arms 46, as shown in FIGS. 3 and 5. Control arm 38 extends between the vertical guides 8, between guide rollers 48, and terminates at connecting end 50 located behind guide members 8 and guide rollers 48. Attached to the connecting end 50 by a clevis 52 is the rod end of a hydraulic or air cylinder 54.

When it is desired to move the upper die 30 and lower die 32 away from one another from the retracted position shown in FIG. 2 to the separated position shown in FIG. 3 to practice the method of the present invention, cylinders 22 and 24 are simultaneously energized with cylinder 54 to cause the die support members 14 and 16 to move away from one another and to cause cylinder 54 to retract its extended rod thus moving control rod 38 from right to left as viewed in FIG. 2. When this occurs the pivoting linkage arms 44 and 46, as shown in FIG. 5 cause the upper die member 30 and the lower die member 32 to move away from one another at the same rate relative to the axis of the control rod 38. Also, since the upper die 30 and the lower die 32 are rigidly attached to the upper support member 14 and the lower support member 16 respectively, there is no horizontal movement of the upper and lower die members. The apparatus could be modified to support the upper and lower die members in a pivoting manner and with the control arm 38 mounted in a fixed position, but in such a modification it would be necessary that the horizontal movement of the upper die member be in the same direction and at the same rate as the horizontal movement of the lower die member to prevent twisting of the duct during reshaping.

In the apparatus shown, the cylinders 22, 24, and 54 are hydraulic cylinders and are manipulated by a conventional electric motor driven pump and valve assembly with fluid reservoir 56 and electrical controls 58 mounted on frame 6 which allows the apparatus to be portable.

The apparatus is used to reshape lengths of duct that typically are about 10 feet long thus requiring that the upper and lower die members 30 and 32 extend beyond the front of the die support members 14 and 16 at least 10 feet. The weight of these die members, and the control arm 38, because of the canilever mounting, place substantial stress on the die support members 14 and 16 and on the vertical guides 8. This stress can be eliminated when the apparatus is not in use by a conventional jack 60. Any conventional support can be used as the jack 60, but the jack illustrated here is pivotably mounted to the frame 6 by pin 62 and bracket 64 thus allowing the jack 60 to pivot down out of the way when the apparatus is being used, as shown in FIG. 3. The jack 60 is adjustable in that a threaded portion 66 is adjustably threaded into the main jack member 68 by rotation of a handle 70.

As best shown in FIG. 5, the upper and lower die members 30 and 32 are machined out at the proper intervals along the interior face of the dies to provide indentations 72 into which the linkage arms 44 and 46 can fit when the dies and linkage assembly is in a retracted position as shown in FIG. 2. These features are critical because it is necessary that the dies and linkage assembly can retract to a very compact state in order that a relatively small diameter round duct can be slipped over the dies and linkage assembly in order to make relatively small rectangular duct. In the embodiment illustrated here, the linkage arms form an angle of about 14° with the axis of the control rod 38 when the dies are in a fully retracted position, but a larger angle is preferable.

As shown in FIG. 5 the control rod 38 in the present apparatus is comprised of two arms 76 and 78 held together by spacers 42 and screws 39 which are threaded into the ends of the spacers 42.

Figure 6:
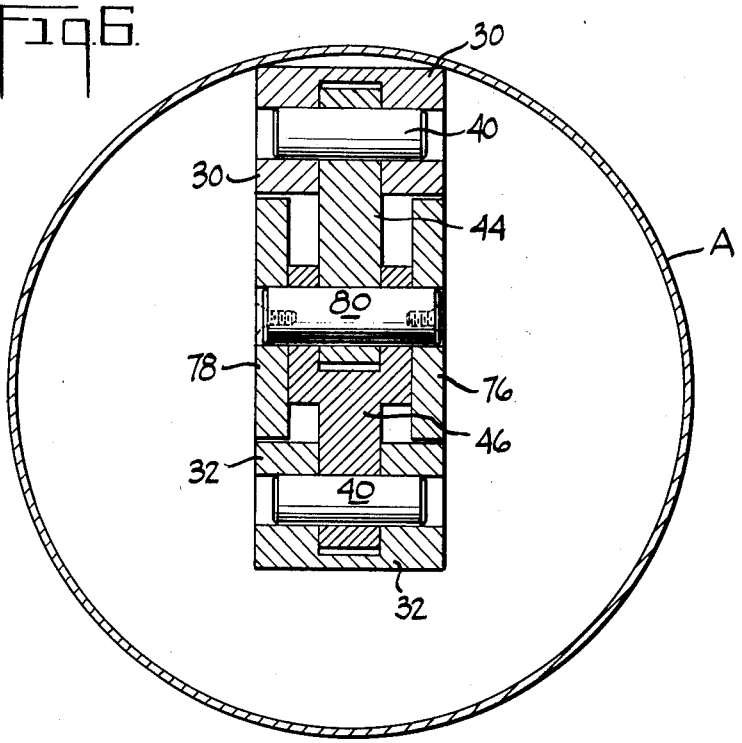
FIG. 6 is a cross section of a set of forming members in the retracted position and linkage assembly for making a rectangular duct and shown inserted into a round duct.
Figure 7:
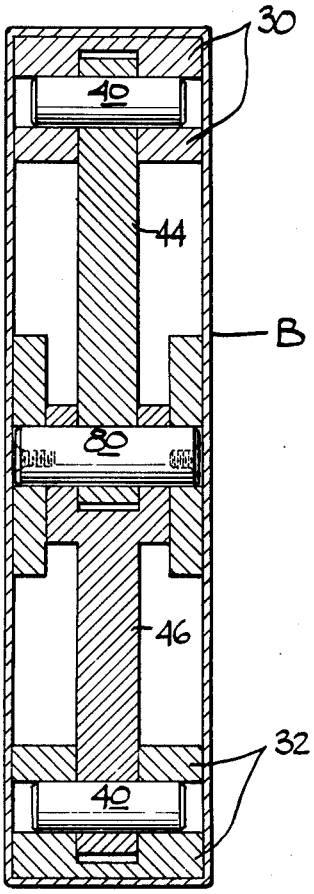
FIG. 7 is a cross section of the apparatus shown in FIG. 6, but the forming surfaces are in an extended position having reshaped the round duct to a rectangular duct.

As shown in FIGS. 6 and 7 upper and lower linkage arms 44 and 46 are pivotly attached to upper and lower die members 30 and 32 by pins 40. The pins 40 can be fixed to the upper and lower die members 30 and 32 by set screws that tighten against pins 40 in a conventional manner (not shown). In the embodiment shown in FIGS. 6 and 7 the lower linkage arm is made in the form of a clevis at the end connected to pin 80 and thus pivots around the upper linkage arm 44 on pin 80. The clevis is machined out sufficiently to provide clearance for upper linkage arm 44 so that the dies can be fully retracted. These upper and lower linkage arms 44 and 46 are also pivotaly attached between arms 76 and 78 by pin 80 about which the linkage arms 44 and 46 pivot as the dies 30 and 32 are moved apart or retracted. The pins 80 can be fixed to arms 76 and 78 by set screws that tighten against the pins in conventional manner (not shown) or retained by other suitable fastening devices, e.g. D shaped washers.

Figure 8:
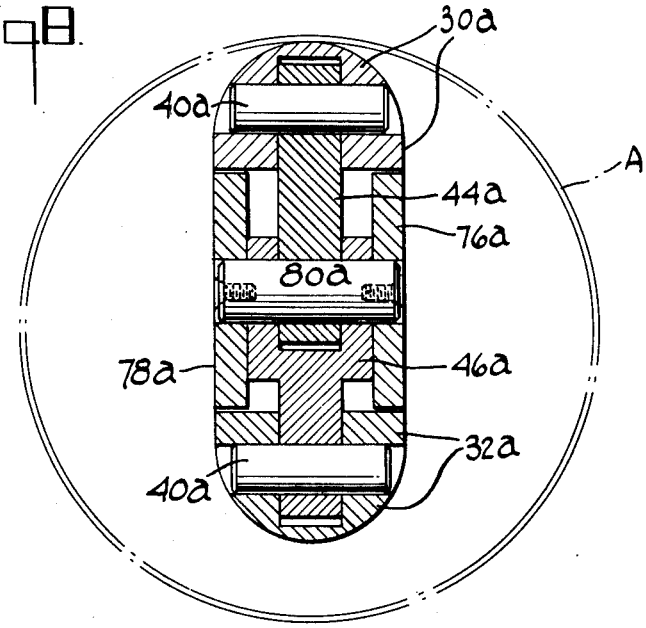
FIG. 8 is similar to FIG. 6, but shows forming surfaces and linkage assembly suitable for making flat/oval duct.

The apparatus of the present invention can also be used to form other shapes from round duct, e.g. flat/oval duct, by modifying the upper and lower die members as shown in FIG. 8. The assembly shown in FIG. 8 is identical to the assembly shown in FIG. 6 except for the shape of the upper and lower die members, thus the elements are numbered similarly with the exception of the suffix *a* following the element numbers in FIG. 8. The rectangular duct of the present invention is preferred over a flat/oval duct that would be made using an assembly shown in FIG. 8 because the cross-sectional area of a rectangular duct would be greater for the same width or thickness dimension than that of a flat/oval duct.

Figure 9:
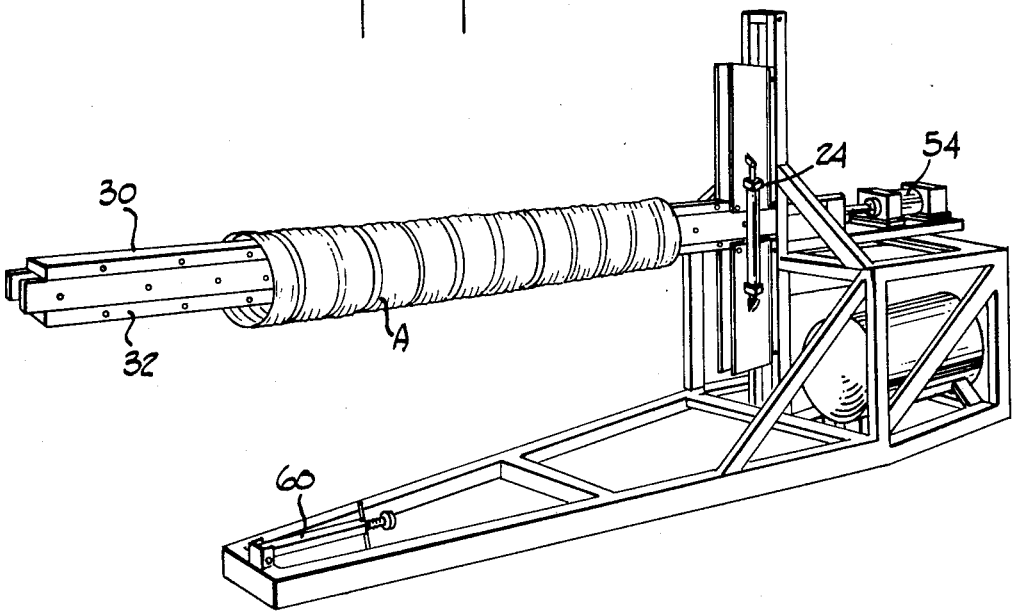
FIG. 9 is a perspective view of the apparatus illustrated in FIGS. 2–7 with the forming surfaces in a retracted position and a round duct in place ready to be reshaped into a rectangular duct.

In the operation of the apparatus disclosed according to the method of the present invention to make the rectangular duct of the present invention, reference is made to FIGS. 5–7 and 9. Referring first to FIG. 9 jack 60 is lowered out of the way and a round duct A is slipped over the upper and lower dies 30 and 32. To make a rectangular duct measuring 8 × 3¼ inches a round duct having an I.D. of about 7 inches would be used. Cylinders 22, 24, and 54 are then energized in such a manner to move upper die support member 14 upwardly, lower die support member 16 downwardly, and control rod 38 from left to right as viewed in FIGS. 5 and 9, (also see the arrows showing the directions of movement of the various members in FIG. 5). This movement is continued until the forming surfaces of the upper and lower die members 30 and 32 are in the desired position to reshape the round duct A to the rectangular shape B shown in FIG. 7. Preferably, the upper and lower dies 30 and 32 are moved slightly farther apart to cause the metal of the duct to yield slightly to remove excessive bowing and insure straight sides on the rectangular duct after the upper and lower dies are retraced. Having reached that point, the upper and lower dies are retracted back to their position shown in FIG. 6 and the rectangular duct B is removed. The maximum size of rectangular duct that can be made without modifying the apparatus will depend upon the length of the linkage arms 44 and 46. The minimum size duct that can be made will depend upon the compactness of the retracted upper and lower die and linkage arm assembly. Various size ducts can be made on the same apparatus by varying the amount that the control arm 38 is moved horizontally. Also, wider upper and lower dies 30 and 32 can be used, e.g., by placing wider saddle members over existing upper and lower dies 30 and 32 to make wider or thicker rectangular ducts without changing any of the other parts of the apparatus.

Although the apparatus is shown mounted horizontally on frame 6, it could also be mounted vertically with the upper and lower dies and control rod hanging vertically downward or extending vertically upward. Also, instead of moving the round duct onto, and the rectangular duct off of, an apparatus maintained in a fixed position, the duct could be maintained in a fixed position and the apparatus could be moved forward and backward, or up and down.

In describing the invention certain embodiments have been used to illustrate the invention and the practice thereof. However, the invention is not limited to these specific embodiments as other embodiments and modifications within the spirit of the invention will readily occur to those skilled in the art of reading this specification. The invention is not intended to be limited to the specific embodiments disclosed, but instead is to be limited only by the claims appended hereto.

I claim:

1. A method of making a rectangular duct that is light weight and bendable without significantly changing the cross-sectional area of the duct at the bend comprising reshaping a round thin walled spirally grooved metal duct having a metal wall thickness between three mils and six mils into a rectangular shape by applying reforming forces simultaneously to different portions of the interior surface of the round duct, said reforming forces having a vertical displacement with respect to one another, but having no significant horizontal displacement with respect to one another, wherein the magnitude of the reforming forces is sufficient to cause the metal in the duct to slightly yield to prevent the tendency of the reformed duct to partially return to its original shape after the reforming forces are removed.

2. An apparatus comprising two or more forming members for insertion into the interior of a hollow duct, means for supporting said forming members and a surrounding hollow duct in such a manner that forming surfaces on the forming members are generally parallel to each other, and means for moving said two or more forming surfaces apart in a direction perpendicular to the aixs of the duct while preventing any significant horizontal movement of the forming surfaces with respect to one another, wherein the two or more forming surfaces comprise an upper forming surface and a lower forming surface connected together by pivoting linkage arms, said linkage arms also being pivotably connected to a generally centrally located control rod, the horizontal movement of the control rod causing the upper forming surface and the lower forming surface to move away from the axis of the control rod in a simultaneous manner and at an equal rate, said forming members being rigidly attached to support members that move up and down along vertical guides as the upper and the lower reforming surfaces move away from one another, and at least one means attached to said support members for forcing the upper and lower support members apart in addition to the horizontal movement of the control rod.

3. An apparatus comprising two or more forming members for insertion into the interior of a hollow duct, means for supporting said forming members and a surrounding hollow duct in such a manner that forming surfaces on the forming members are generally parallel to each other, and means for moving said two or more forming surfaces apart in a direction perpendicular to the axis of the duct while preventing any significant horizontal movement of the forming surfaces with respect to one another, said two or more forming surfaces comprising an upper forming surface and a lower forming surface connected together by pivoting linkage arms, said linkage arms also being pivotably connected to a generally centrally located control rod, the horizontal movement of the control rod causing the upper forming surface and the lower forming surface to move away from the axis of the control rod in a simultaneous manner and at an equal rate, and wherein one end of each of said linkage arms is pivotably attached to a forming member in an indentation in said forming member and the other end of each of said linkage arms is pivotably connected to the interior of said control rod whereby said forming members can be fully retracted such that the upper and lower forming members are in contact with the control rod.

* * * * *